US005326403A

United States Patent [19]

Iwanaga

[11] Patent Number: 5,326,403

[45] Date of Patent: Jul. 5, 1994

[54] EQUIPMENT FOR DISCHARGING TREATED ARTICLES FROM A BARREL IN A SURFACE TREATMENT SYSTEM

[75] Inventor: Akira Iwanaga, Mitaka, Japan

[73] Assignee: Towa Koki Kabushiki Kaisha, Tokyo, Japan

[21] Appl. No.: 980,640

[22] Filed: Nov. 24, 1992

[30] Foreign Application Priority Data

Dec. 5, 1991 [JP] Japan ..... 3-348227

[51] Int. Cl.[5] ..... B05C 3/00

[52] U.S. Cl. ..... 118/429; 118/423; 118/418; 118/19; 118/695; 118/696; 118/704

[58] Field of Search ..... 118/429, 19, 417, 418, 118/421, 695, 696, 704, 423

[56] References Cited

U.S. PATENT DOCUMENTS

| | | | |
|---|---|---|---|
| 1,850,576 | 3/1932 | Zimmerman | 118/421 |
| 3,102,052 | 8/1963 | Ackles | 118/418 |
| 3,286,718 | 11/1966 | Kumpf | 118/418 |
| 3,926,147 | 12/1975 | Steube | 118/418 |
| 4,252,229 | 2/1981 | Corbett | 118/418 |
| 4,476,804 | 10/1984 | Glatt et al. | 118/19 |
| 4,543,906 | 10/1985 | Glatt et al. | 118/19 |
| 4,753,255 | 6/1988 | Melin | 118/418 |
| 4,769,117 | 9/1988 | Shiono et al. | 118/418 |
| 5,056,456 | 10/1991 | Kobayashi | 118/418 |

FOREIGN PATENT DOCUMENTS

| | | | |
|---|---|---|---|
| 3302588 | 12/1983 | Fed. Rep. of Germany | 118/19 |
| 53-47057 | 12/1978 | Japan . | |
| 61-194199 | 8/1986 | Japan . | |
| 0231191 | 12/1985 | U.S.S.R. | 118/421 |

*Primary Examiner*—W. Gary Jones
*Assistant Examiner*—Brenda Lamb
*Attorney, Agent, or Firm*—Flynn, Thiel, Boutell & Tanis

[57] ABSTRACT

An equipment for discharging treated articles from a barrel in a surface treatment system includes: a carriage movable between a discharging position and a charging position; a water tank supported at the discharging position for vertical movements; and a receiver set at the discharging position above the water tank. The carriage device includes a rotating mechanism for rotating the barrel in water in the tank at the discharging position to discharge the articles from the barrel onto the receiver; a cover operating mechanism for removing a cover from an aperture of the barrel at the discharging position and put it on the aperture at the charging position.

6 Claims, 3 Drawing Sheets

EQUIPMENT FOR DISCHARGING TREATED ARTICLES FROM A BARREL IN A SURFACE TREATMENT SYSTEM

BACKGROUND OF THE INVENTION

1. Field of the Invention

This invention relates to an equipment for discharging treated articles, automatically, easily and completely, from a barrel which contains the articles during surface treatments, such as galvanizing, coating and etching, in a surface treatment system.

2. Description of the Prior Art

For galvanizing, for example, metal articles in an automatic plating apparatus, the articles undergo a cycle of predetermined treatments in the order of pre-treatments, galvanization and after-treatment. For this purpose, a processing line is prepared by arranging liquid-containing tanks in a desired order. Relatively large articles to be surface-treated are hung from a transporter which moves along a rail extending above the processing line. At a point during the movement, the transporter is lowered to immerse the article in a treatment liquid in a tank for one of the desired surface treatments, and it is moved up to remove the article from the treatment liquid. Then the transporter runs to a next point for a next treatment by a next treatment liquid.

Relatively small articles to be treated are held in a cylindrical porous container, called "barrel", which is hung from the transporter, throughout the entire cycle of predetermined treatments. After a final treatment, the articles are discharged from the barrel, and the barrel is sent to a next cycle of the same treatments after charged with new pre-treated articles. The barrel has an aperture in its peripheral wall normally closed by a cover, so that articles are charged or discharged through the aperture.

It is sometimes difficult to discharge the full amount of treated articles from the barrel. In case of cubic, spherical or rod-shaped articles contact whose contacting areas with the barrel are relatively small, it is not difficult to discharge the full amount of such articles even if they are light-weight. However, light-weight flat-shaped articles, which may contact with the barrel with large flat areas, are apt to cling or stick to inner surfaces of the barrel. Once the articles cling to the barrel, it is difficult to remove them from the barrel even by applying vibrations, because a surface tension of a treatment liquid film existing between the articles and the inner surface of the barrel holds the articles on the barrel wall.

If the treated articles remain in the barrel, they are again sent to a next processing cycle together with newly charged pre-treated articles. As a result, the next discharged cargo will contain double-treated defective articles. Therefore, the reliability on the products or the yield of products is decreased.

It is certainly very difficult to remove articles clinging to the barrel with a surface tension of a liquid film. Scraping and repeated application of an impulse to the barrel may be effective to a certain extent; however, it is troublesome to scrape out such articles by inserting a tool to the interior of the barrel, and strong impulse may damage treated products.

A prior art disclosed in Japanese Patent Kokai Publication No. Sho 61-194199 proposes to remove articles from a barrel wall by using a jet stream of water sprayed out through a nozzle into the barrel held in the air. However, much energy is required to provide an effectively strong jet of water, and it takes much time to remove such articles from the barrel. Moreover, despite such efforts, some of the articles may still remain on the barrel wall.

OBJECT OF THE INVENTION

It is therefore an object of the invention to provide an equipment for use in a surface treatment system, which can automatically, readily, reliably remove and discharge light-weight articles from a barrel which holds the articles throughout the entire cycle of predetermined treatments, even in the case that the articles are apt to cling or stick to inner surfaces of the barrel with a surface tension of a treatment liquid film between the articles and the inner surfaces of the barrel.

SUMMARY OF THE INVENTION

According to the invention, there is provided an equipment for discharging articles from a barrel in a surface treatment system, comprising:

a carriage device supported for reciprocal movements in a horizontal direction between a first horizontal position where the articles are discharged from the barrel and a second horizontal position where new articles are charged in the barrel, the carriage device including a rotating mechanism for engagement with the barrel to rotate the barrel and a cover operating mechanism for engagement with a cover of an aperture of the barrel;

a fluid tank supported at the first position for vertical movements between a highest first vertical position which is highest and a second vertical position which is lowest; and a receiver removably set at the first position at a third vertical position where the receiver enters in the fluid tank when the fluid tank is moved to the first vertical position.

After an entire cycle of predetermined treatments in a surface treatment system, the barrel is delivered from a transporter of the system to the carriage device which is waiting for the barrel at the discharging position. Then the tank is elevated to immerse the barrel in water contained in the tank, and the barrel is rotated in the water. The rotation makes an irregular water stream in the water, and the irregular water stream hits some of articles clinging to inner surfaces of the barrel, or causes some of floating articles to hit clinging articles. As a result, the articles heretofore clinging to the barrel wall are removed therefrom, and they drop and accumulate on the bottom. That is, by making an irregular stream of water in and around the barrel in the water, articles in the barrel, even liable to clinging or sticking troubles caused by a liquid film because of the weight and shape of the articles, are readily released from the inner surface of the barrel.

In this status, when the barrel is stopped at a posture where the aperture is oriented upward, the cover is removed to open the aperture of the barrel. With further rotation of the barrel thereafter, the articles are progressively discharged from the barrel as the aperture is oriented downward. When the aperture reaches the lowest position of the barrel, all of the articles are discharged from the barrel and received in an appropriate removable porous container such as a basket. As a result, the barrel becomes completely empty.

After that, rotation of the barrel is stopped, the water tank is moved down, and the carriage device carrying the empty barrel thereon is moved to the charging position in which the empty barrel is charged with new to be next treated. Since the barrel is completely empty before it is re-charged, the barrel contains only new pre-treated articles when it is sent to a next cycle of the same processing line. Therefore, it is prevented that some of articles undergo surface treatment twice or thrice and cause defective products, and the reliability on the products and the yield of the products are increased.

After shutting the aperture with the cover, the carriage delivers the barrel to the transporter, and it returns to the discharge position and waits for arrival of a next barrel.

Since the carriage itself is equipped with mechanisms for rotating the barrel and for removing the cover, the entire process, from receipt of the barrel at the end of a processing cycle, through the discharging and charging operation, to delivery of the barrel to a next processing cycle, can be fully automated.

These and other features of the invention will be illustrated by a preferred embodiment described below with reference to the attached drawings.

DETAILED DESCRIPTION OF A PREFERRED EMBODIMENT

Figure 7:
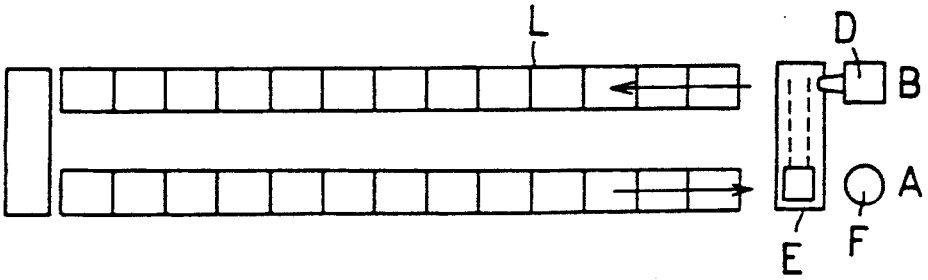
FIG. 7 is a schematic plan view of a processing line for plating to which the invention is applied.

With reference to FIG. 7 schematically showing a cycle of successive treatments for galvanization, an empty barrel is charged with a certain amount of pre-treated articles from a chute D at a charging position B and moved along a processing line L including tanks, containing liquids for pre-treatments such as degreasing, rinsing and neutralization, galvanization, and after-treatments, which are aligned in sequence toward a discharging position A. While the barrel is moved, articles in the barrel undergo a cycle of sequential predetermined treatments. When the barrel reaches the discharging position A adjacent to the charging position B, treated articles are discharged from the barrel by a discharging equipment according to the invention, and the empty barrel is delivered to the charging position B. The empty barrel is again charged with next pre-treated articles and sent out to the processing line L for a next cycle of the same treatments. The treated articles discharged from the barrel by the discharging equipment E are delivered to a dehydrator F for dewatering, further to a next process for inspection, packaging, and so on.

Figure 1:
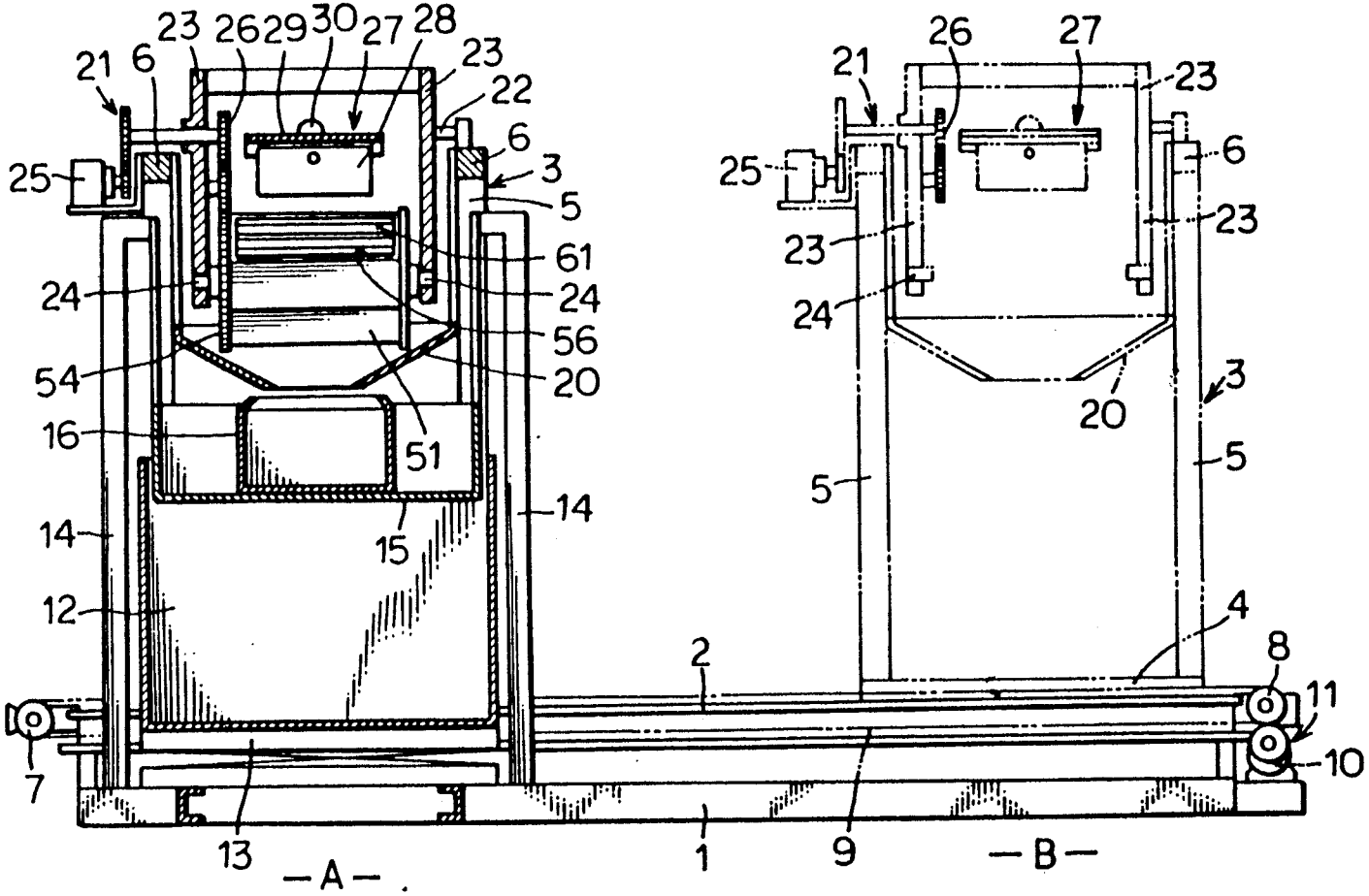
FIG. 1 is a longitudinal cross-sectional view of an equipment embodying the invention.
Figure 2:
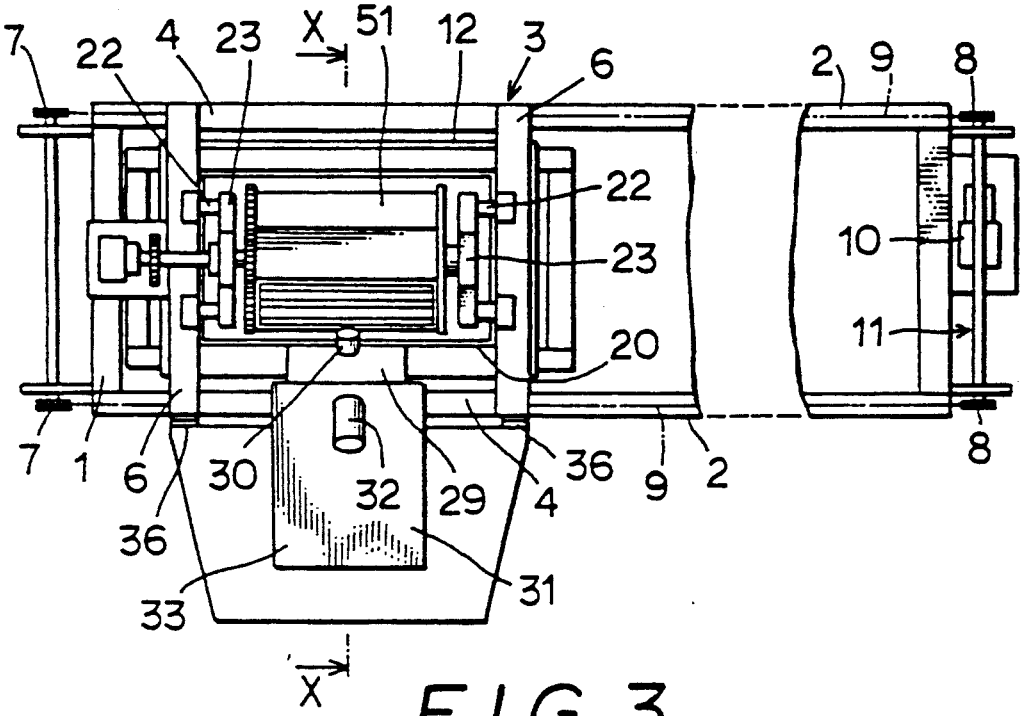
FIG. 2 is a plan view of the equipment of FIG. 1.
Figure 3:
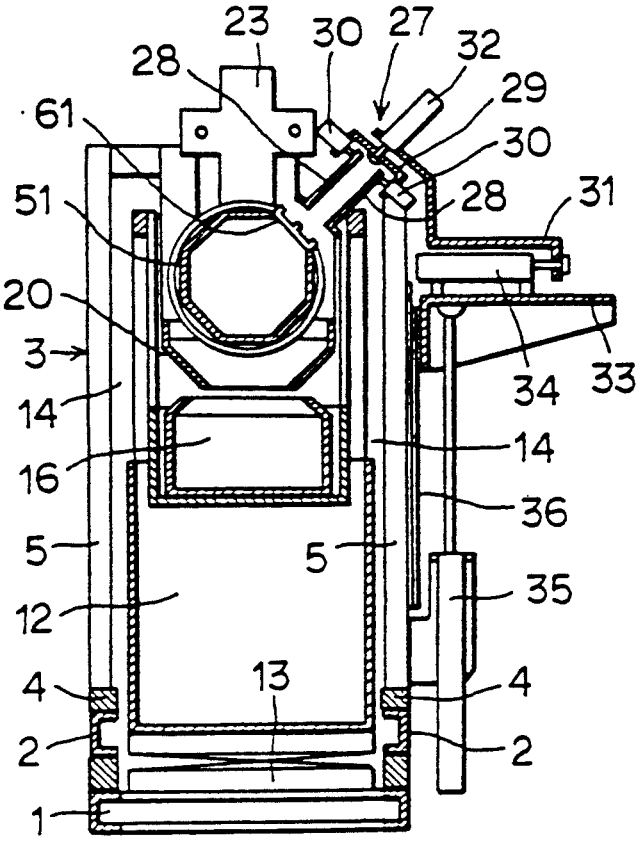
FIG. 3 is a cross-sectional view taken along the X—X line of FIG. 2.

With reference to FIGS. 1 to 3, the discharging equipment E includes a base 1 put on a floor, a pair of parallel rails 2, 2 provided on the base 1, a chute 20, a rotating mechanism 21, a carriage 3 having a cover operating mechanism 27 and supported for movements along the rails 2, 2, a tank 12 containing cleaning liquid such as water and located in the discharging position A, and a receiver shell 16 put in the tank 12. The carriage 3 reciprocates between the discharging position A and the charging position B along the rails 2, 2 to receive a barrel 51 downstream of the final step of the processing line L and delivers it to a transporter upstream of the first stage of the processing line L.

The carriage 3 includes two horizontal support member 4, 4 horizontally extending along and supported on the rails 2, 2 via some rotational wheels or rollers or via slidable members; four vertical support bars 5, 5 vertically extending from opposite ends of the horizontal support members 4, 4; horizontal support bars 6, 6 horizontally extending across the extending direction of the horizontal support members and connecting upper ends of the vertical support bars 5, 5. The carriage 3 is moved from the discharging position B to the charging position A, or vice versa, by a reciprocal driving mechanism 11. The mechanism 11 includes chain sprockets 7, 8 provided at opposite ends of the rails 2, 2; chains 9 each engaging the chain sprockets 7, 8 and coupled to opposite ends of an associated one of the horizontal support members 4, 4 to form a closed loop consisting of the chain and the horizontal support member 4; and a reversible hydraulic or electric motor 10, for synchronously rotating the sprockets 8, 8 in a desired direction to drive the carriage 3 via the chain 9.

At the discharging position A between the rails 2, 2 is located a water tank 12 which is moved vertically by an elevator 13 driven by, for example, a hydraulic motor. Four columns 14 vertically standing from the base 1 support a porous receiver pedestal 15 at a level in which, when the water tank 12 is in its lowest position, the bottom of the receiver pedestal 15 slightly enters in the water tank 12; however, when the water tank 12 is in its highest position, the receiver pedestal 15 enters deep in the water tank 12 to a level where their bottoms nearly engage. The receiver pedestal 15 has a box-like configuration with its upper end being fully open to accept thereon a porous receiver shell 16 set for receiving treated articles discharged from the barrel 51. When the water tank 12 is elevated, the receiver shell 16 enters in the water tank 12 together with the receiver pedestal 15 to a level near the bottom of the water tank 12, and after articles are discharged from the barrel 51 and accumulate in the receiver shell 16, the receiver shell 16 is replaced by another empty receiver shell.

The water tank 12 and the receiver pedestal 15 are arranged to enter between the vertical support bars 5, 5 of the carriage 3 brought to the discharging position A so that they do not prevent movements of the carriage 3.

The rotating mechanism 21 supported to the carriage 3 includes: support arms 22, 22 which are supported on the horizontal support bars 6, 6 having opposed extensions; vertically extending panel-shaped support frames 23, 23 secured to the support arms 22, 22; pivot shafts 24, 24 extending in opposed directions from lower portions of the support frames 23, 23, a reversible hydraulic or electric motor 25 supported on one of the horizontal support bars 6; and a geared transmission device 26 supported by one of the support frames 23.

The barrel 51, when immersed in treatment liquid in a respective tank in the processing line L, is rotated to agitate articles contained therein. The barrel 51 has bearings 55, 55 at the rotational center and a gear 54 for transmission of a rotational force. The barrel 51 also has an aperture 56 provided in its outer periphery and releasable shut by a cover 61.

After the barrel 51 containing articles is transported by the transporter along the processing line L and passes through the final processing stage, it is delivered to the carriage 3 while maintaining the orientation. Then the pivot shafts 24, 24 engage the bearings 55. As a result, the barrel 51 is held in horizontal orientation between the support frames 23, and the gear 54 engages the final-stage gear of the transmission device 26. In this status, since a film of a treatment liquid used in the final treatment remains between some of the articles or between articles and inner surfaces of the barrel 51, some of the articles are held clung to inner surfaces of the barrel 51.

After the barrel 51 is delivered to the rotating mechanism 21 as referred to above, the water tank 12 is elevated from its lowest position to the highest position by the elevator 13 to immerse the entirety of the barrel 51 in the water except its top end. Then the barrel 51 is rotated by the motor 25 to agitate treated articles in the water. During this rotation, some of the articles move down to the bottom of the barrel 51, while hitting other articles, and an irregular water flow produced in the barrel 51 runs along the inner surface of the barrel 51 while hitting or sweeping some of the articles clung to the barrel. As a result, the film of the treatment liquid, which has heretofore hold some of the articles to the inner surface of the barrel, is broken, and the articles are released from the inner surfaces of the barrel. Since the water in the tank does not make a liquid film, the released articles do not cling to the barrel thereafter.

After an appropriate number of rotations, the barrel 51 is stopped at a position where the cover 61 is located at the top. At this time, no article remain clung to the inner surface of the cover 61 because of the reasons explained above. After the cover 61 is removed by the cover operating mechanism 27, the barrel 51 is rotated again. When the aperture 56 is oriented downward, articles drops and exit from the barrel 51 through the open aperture 56. Also after the aperture 56 is opened, the barrel 51 may be rotated by at least one full rotation. Then, no article will remain on the inner surfaces of the barrel, and all of the articles will be discharged from the barrel 51. Articles discharged through the aperture of the barrel 51 drop over a wide area under the barrel 51. However, since the chute 20 guides the articles to the center, all of them are reliably received by the receiver shell 16.

Thereafter, rotation of the barrel 51 is stopped, the water tank 12 is moved down, and the carriage 3 is moved to the charging position B. FIG. 1 illustrates the discharging position A left and the charging position B right. The carriage 3 at the charging position B is drawn with thin lines. When the barrel 51 is moved to the charging position B, with its aperture 56 being oriented upward, the cover operating mechanism 27 keeps the cover off a position where the cover may disturb delivery of pre-treated articles from the chute D to the barrel 51. After a predetermined amount of pre-treated articles is charged in the barrel 51, the aperture 56 is shut by the cover 61, and the barrel 51 is delivered to the transporter on the processing line L. The unloaded carriage 3 returns to the discharging position A and waits for a next barrel 51.

Figure 4:
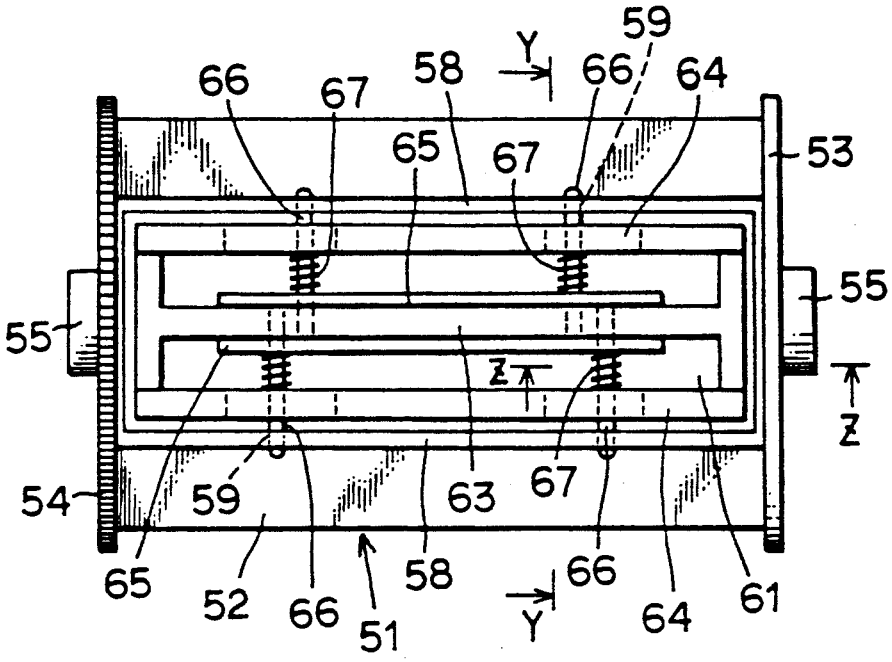
FIG. 4 is a front elevation of a barrel.
Figure 5:
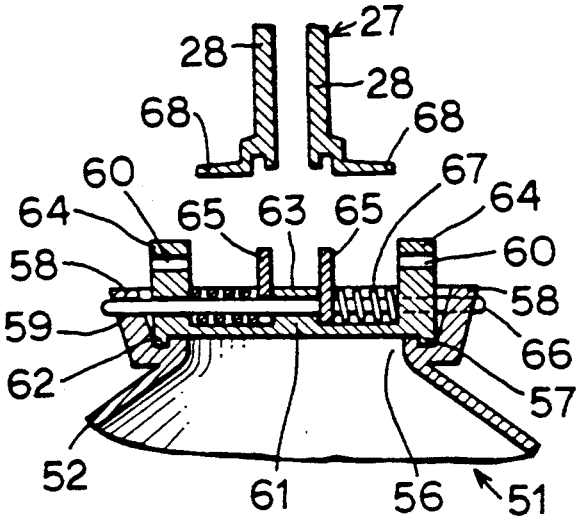
FIG. 5 is an enlarged fragmentary cross-sectional view taken along the Y—Y line of FIG. 4.
Figure 6:
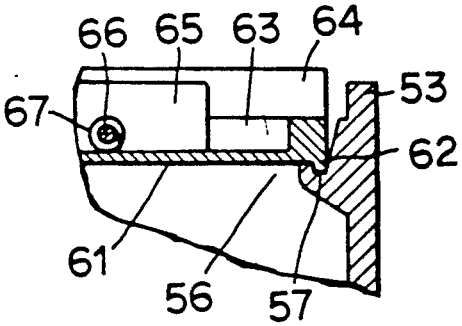
FIG. 6 is an enlarged fragmentary cross-sectional view taken along the Z—Z line of FIG. 4.

With reference to FIGS. 4 to 6, the barrel 51 includes an open-ended octagonal cylindrical rigid body 52, a round flange 53 closing one end of the cylindrical body 52, a geared plate 54 closing the other end of the cylindrical body 52, and bearings 55, 55 at the centers of the flange 53 and the geared plate 54. One of eight axially extending surfaces of the cylindrical body 52 is the aperture 56 around which a groove 57 is provided. The others of the eight surfaces of the cylindrical body 52 are defined by axially extending panels having a number of bores.

The cover 61 for closing the aperture 56 has a closing rib 62 provided on its back surface for engagement with the groove 57. On the upper surface of the cover 61, an axially extending central regulating rib 63 is provided in its center, and axially extending lateral regulating ribs 64, 64 define its opposite side margins. In the opposite sides of the closing rib 63 are provided a pair of axially elongated movable plates 65, 65. A plurality of engaging rods 66 extend in horizontal directions from each of the movable plates 65, 65 through the other operating plate 65 and the guide rib 64, and engage with bores 59 formed in cover engaging ribs 58 provided on the barrel 51 beyond the groove 57. A resilient member 67 in the form of a coil spring is mounted on each of the engaging rod 66 in a compressed condition between an associated set of the guide ribs 64 and the operating plate 65. Thus the movable plates 65, 65 are normally resiliently held in close contact with the central regulating rib 63, with its engaging rods 66 held in engagement with the bores 59 in the cover engaging ribs 58 of the barrel 51, to shut the aperture 56. The barrel 51, the cover 61, the movable plates 65, and the engaging rods 66 may be hard synthetic resin elements.

The cover operating mechanism 27 for putting the cover 61 on and off the aperture 56 includes: cover engaging members 28, 28 having substantially the same length as and engaging with the movable plates 65, 65, respectively; hydraulic cylinders 30, 30 supported by a first frame 29 in opposed orientation to cause parallel movements of the cover engaging members 28, 28 toward and away from each other; a hydraulic cylinder 32 supported by a second frame 31 to move the first frame 29 in radial directions of the barrel 51; a hydraulic cylinder 34 supported on a third frame 33 to move the second frame 31 so as to bring the cover 61 and its associated members outside the support column 14; and a hydraulic cylinder 35 supported by one of the vertical support bars 5 of the carriage 3 for moving the third frame 33 so as to retreat the cover 61 to a position where it never disturb charging of pre-treated articles. The third frame 33 is moved in a vertical direction along the vertical support bar 5 by a vertical guide 36.

When the barrel 51 is rotated in the water tank 12 and stopped at a position where the cover 61 is oriented upward, the hydraulic cylinder 32 is activated to bring the cover 61 engaging members 28, 28 into engagement with the movable plates 65, 65, respectively. Then the hydraulic cylinders 30, 30 are activated to move the cover engaging members 28, 28 away from each other while compressing the springs 67, 67 to draw out their engaging rods 66 from the bores 59. At the same time, engaging plates 68, 68, which extend from the respective cover engaging members 28, 28 in the opposite directions to that of the engaging rods 66, 66, engage with slits 60, 60 provided in the lateral regulating ribs 64, 64.

That is, since the cover 61 is released from the barrel 51 and caught by the cover engaging members 28, 28, the cover 61 is removed from the barrel by driving the hydraulic cylinder 32. Thus, with further rotation of the barrel 51, articles are discharged from the barrel 51 through the open aperture 56.

When the carriage 3 is moved to the charging position B after articles are discharged from the barrel 51, the cylinder 34 is operated to laterally move the cover 61 and its associated members. Next, the hydraulic cylinder 35 is operated to withdraw the cover 61 and its associated members to a lower position where they do not disturb charging of pre-treated articles. After the barrel 51 is charged with pre-treated articles, the cover 61 is put on the aperture 56, and the cover engaging members 28, 28 are pressed to each other to release the cover 61 and let it engage the barrel 51 automatically, in the opposite sequence of the above-mentioned behaviors. Then the barrel 51 is sent to the processing line L. After that, the cover engaging members 28, 28 and other members are moved back to their positions where they do not hit the support columns 14, and the carriage 3 is returned to the discharging position A.

What is claimed is:

1. An equipment for discharging articles from a barrel in a surface treatment system, comprising: a carriage device supported for reciprocal movement in a horizontal direction between a first horizontal position where said articles are discharged from said barrel and a second horizontal position where new articles are charged in said barrel, said carriage device including a rotating mechanism for engagement with said barrel to rotate said barrel and a cover operating mechanism for engagement with a cover of an aperture of said barrel; a fluid tank supported at said first horizontal position for vertical movement between a first vertical position and a second vertical position which is lower than said first vertical position; and a receiver removably supported at said first horizontal position at a third vertical position where said receiver enters in said fluid tank when said fluid tank is moved to said first vertical position; wherein said rotating mechanism rotates said barrel at a fourth vertical position where said barrel is above said receiver and substantially fully enters in said fluid tank when said fluid tank is moved to said first vertical position; wherein said cover includes first means for releasable engagement with said barrel with a resilient force to shut said aperture, and includes second means for engagement with said cover operating mechanism; and wherein said cover operating mechanism includes: third means for releasable engagement with said first means of said cover for releasing said cover from said barrel against said resilient force, fourth means for releasable engagement with said second means of said cover when said third means engages with said first means, and driving means for bringing said third means and said fourth means into engagement with said first means and said second means when said carriage is located at said first horizontal position.

2. The equipment according to claim 1, wherein said driving means of said cover operating mechanism drives said third and fourth means into engagement with said first and second means of said cover when said barrel is rotationally oriented to locate its aperture at its highest position after a predetermined number of rotations of said barrel, then holds said cover engaged by said third and fourth means in a position where they do not prevent further rotation of said barrel, and brings said third and fourth means toward said aperture of said barrel and releases them from said first and second means of said cover after said barrel is charged with said new articles at said second horizontal position.

3. The equipment according to claim 2 wherein:

said barrel includes a pair of cover engaging ribs which extend in parallel along opposite sides of said aperture and have a plurality of bores;

said first means of said cover includes a central regulating rib provided on an outer surface of said cover; two lateral regulating ribs provided on said outer surface of said cover and extending in parallel with said central regulating rib; two movable members extending in parallel with said central and lateral regulating ribs and located between said central rib and said lateral ribs; a plurality of rods horizontally extending from each said movable member for engagement with said bores in said cover engaging ribs of said barrel beyond said central rib, the other of said movable members and said lateral regulating rib; and resilient means normally holding each of said movable members in close contact with said central regulating rib and holding said rods in engagement with said bores in said cover engaging ribs of said barrel;

said second means is a pair of slits provided in said lateral regulating ribs;

said third means is a pair of catching members which can grasp said movable members of said cover and can shift them away from each other against said resilient force; and said fourth means is a pair of cover clamping plates extending from said catching members in opposite directions for engagement with said slits of said lateral regulating ribs.

4. An apparatus for discharging articles from a barrel in a surface treatment system, comprising:

a carriage device supported for reciprocal movement in a horizontal direction between a first horizontal position where said articles are discharged from said barrel and a second horizontal position where new articles are introduced into said barrel, said carriage device including a rotating mechanism for engagement with said barrel to rotate said barrel and a cover operating mechanism for engagement with a cover of an aperture of said barrel;

a fluid tank supported at said first horizontal position for vertical movement between a first vertical position and a second vertical position which is lower than said first vertical position; and a receiver removably supported at said first horizontal position at a third vertical position where said receiver enters in said fluid tank when said fluid tank is moved to said first vertical position;

wherein said rotating mechanism rotates said barrel at a fourth vertical position where said barrel is above said receiver and substantially fully enters in said fluid tank when said fluid tank is moved to said first vertical position.

5. The apparatus according to claim 4, further including a pedestal for supporting said receiver at said third vertical position.

6. The apparatus according to claim 5, further including a chute provided slightly above said pedestal to centralize said articles dropping from said barrel and guide them into said receiver set at said third vertical position.

* * * * *